US005786065A

United States Patent [19]

Annis et al.

[11] Patent Number: 5,786,065

[45] Date of Patent: Jul. 28, 1998

[54] ABRASIVE NONWOVEN WEB

[75] Inventors: Vaughan R. Annis, South Windsor; John J. Walker, Enfield; Scott H. Murdock, Suffield, all of Conn.

[73] Assignee: The Dexter Corporation, Windsor Locks, Conn.

[21] Appl. No.: 819,324

[22] Filed: Mar. 18, 1997

Related U.S. Application Data

[63] Continuation of Ser. No. 573,412, Dec. 15, 1995, abandoned.

[51] Int. Cl.[6] ..... D04H 13/00

[52] U.S. Cl. ..... 428/141; 428/212; 442/411; 442/414; 442/416

[58] Field of Search ..... 442/411, 414, 442/416; 428/141, 212

[56] References Cited

U.S. PATENT DOCUMENTS

| | | | |
|---|---|---|---|
| 4,315,965 | 2/1982 | Mason et al. | 428/198 |
| 4,659,609 | 4/1987 | Lamers et al. | 428/194 |
| 4,718,898 | 1/1988 | Puletti et al. | 604/366 |
| 4,775,582 | 10/1988 | Abba et al. | 428/288 |
| 4,833,003 | 5/1989 | Win et al. | 428/198 |
| 5,310,590 | 5/1994 | Tochacek et al. | 428/102 |
| 5,336,556 | 8/1994 | Yoshida et al. | 428/288 |

FOREIGN PATENT DOCUMENTS

| | | |
|---|---|---|
| 0 549 948 | 7/1993 | European Pat. Off. . |
| 0 615 720 | 9/1994 | European Pat. Off. . |
| 2 267 680 | 12/1993 | United Kingdom . |
| 2 267 681 | 12/1993 | United Kingdom . |

*Primary Examiner*—Kathleen Cho
*Attorney, Agent, or Firm*—Alix, Yale & Ristas, LLP

[57] ABSTRACT

An abrasive nonwoven fibrous web material is produced by initially forming a nonabrasive precursor nonwoven fibrous web material having on a first planar surface thereof a substantially uniform distribution of attenuated meltable thermoplastic fibers, such as polypropylene fibers. The precursor web is heated sufficiently to cause the attenuated thermoplastic fibers therein to shrink and form nodulated fiber remnants that impart a roughened abrasive character to the planar surface of the resultant web material. The concentration of the abrasive fiber remnants decreases across the thickness of the web material from the abrasive planar surface toward the opposite planar surface of the web to provide an abrasive fiber remnant gradient across the web. The nodulated abrasive fiber remnants comprise about 10%–50% by weight of the total fiber content of the web material and exhibit an average particle size of at least about 100 micrometers.

9 Claims, 3 Drawing Sheets

ABRASIVE NONWOVEN WEB

This application is a continuation of application Ser. No. 08/ 573,412 filed on Dec. 15, 1995, now abandoned.

TECHNICAL FIELD

The present invention relates generally to an abrasive nonwoven fibrous web material and is more particularly concerned with a new and improved nonwoven web material particularly useful as a dry or wet abrasive wipe or towel for the removal of dirt or grease.

BACKGROUND OF THE INVENTION

Nonwoven web materials are well-known for a wide variety of end uses, including abrasive wipes and towels, both wet and dry. Abrasive wipes currently on the market are multilayer structures of the type described in Lamers et al U.S. Pat. No. 4,659,609, issued Apr. 27, 1987, and entitled "Abrasive Web and Method of Making Same". These multilayer composite materials employ a spunbonded, continuous filament, supporting layer carrying one or more outer layers of melt-blown abrasive fibers bonded to the support. The meltblown abrasive fibers are thicker than conventional meltblown fibers and are thermally bonded to the supporting web. The resulting layered web is said to exhibit the strength of the spunbonded supporting web and the abrasiveness of the meltblown layer carried thereon. The filaments within the spunbonded support web material should exhibit a softening point sufficiently lower than that of the polymer melt extruded in the melt blowing operation in order for thermal bonding to occur between the substrate and the abrasive layer. In the melt blowing process, the molten polymer is extruded into filaments that are disrupted by forced hot air to form discontinuous semimolten fiber fragments containing aggregate-like masses or "shot". The fiber fragments impinge on the spunbonded support web and intimately thermally bond thereto as solidification of the molten polymer is completed. As mentioned in the Currie et al British published patent applications 2,267,681A and 2,267,680A, both published on Dec. 15, 1993, these materials exhibit inadequate absorbency and interlayer cohesion and may delaminate when subjected to the severe shearing forces encountered during a wiping operation. Additionally, the abrasiveness is considered to be unsatisfactory. Currie et al therefore suggest the incorporation of an additional interior meltblown layer to improve absorbency. Win et al U.S. Pat. No. 4,833,003, issued May 23, 1989, and entitled "Uniformly Moist Abrasive Wipes", also describes the use of a meltblown supporting layer to improve absorbency of abrasive webs, but otherwise follows the teaching of the Lamers et al U.S. Pat. No. 4,659,609.

Unfortunately, the meltblown abrasive fibers, due to their size and irregular configuration, are not uniformly distributed across the surface of the support layer and necessarily rest solely on top of the supporting web without significantly penetrating the support material so as to be imbedded or anchored therein. Additionally, the irregular shape of the meltblown fibers is produced prior to the deposition of the meltblown fiber fragments onto the supporting structure thereby also leading to nonuniformity of distribution of the abrasive fiber fragments. Further, the meltblown material preferably has a relatively high content of course shot-laden or "shotty" deposits that do not provide good interfiber bonding.

SUMMARY OF THE INVENTION

In accordance with the present invention, it has been found that a more uniform distribution of abrasive particles can be achieved by initially forming a substantially uniform surface distribution of nonabrasive thermoplastic fibers on and within a fibrous web material and subsequently treating the web material so that those fibers nodulate in situ, after being integrated within the web, to impart the desired roughened, abrasive characteristics to the web material. This not only enhances the uniformity of the fiber distribution on the web's surface, since the dispersible fibers are deposited prior to nodulation, but also provides for controlling to a limited extent the nodulating characteristics of those fibers. At the same time, it permits distribution of the thermoplastic fibers through the thickness of the web material, typically in the form of a concentration gradient extending from one planar surface to the other. The thermoplastic material provides not only highly textured, abrasive surface characteristics, but also bonding characteristics through the thickness of a single layer web material, thereby obviating any possible delamination. This technique further permits the utilization of various different web formation mechanisms, particularly the utilization of a water-laid nonwoven technique without the disadvantages that might be encountered with the utilization of nodulated materials or materials containing the random and irregular distribution of course shot-laden meltblown particles.

Another feature of the present invention is the provision for an abrasive nonwoven fibrous web material that avoids the absorbency drawbacks of the spunbonded/meltblown multilayer structure, while at the same time permitting formation of a single layer structure that completely avoids the interlayer cohesion problems exhibited heretofore due to delamination or inadequate bonding between the various layers of the structure when the material is subject to the severe shearing forces encountered during a wiping operation.

The present invention further provides desirable absorbency coupled with excellent wet strength, bulk, thickness and tear resistance in a pleasant cloth-like nonwoven structure that does not scratch surfaces during use. In addition, the nonwoven web material facilitates handling of the material on automated equipment, as well as both in-line and off-line nodulation of the web material.

The material possesses a unique combination of physical properties such as rapid wettability, absorbent capacity, high wet tensile strength, delamination resistance and superior wet abrasion resistance.

Other features and advantages will be in part obvious and in part pointed out more in detail hereinafter.

These and related features are obtained by providing a single phase abrasive nonwoven fibrous web material having a first abrasive planar surface formed predominantly of substantially uniformly dispersed, nodulated abrasive fiber remnants. The concentration of the abrasive fiber remnants preferably decreases across the thickness of the web material from the first abrasive planar surface toward the opposite planar surface of the web to provide an abrasive fiber remnant gradient across the thickness of the web. The web is produced by initially forming a nonabrasive nonwoven fibrous web material having on its first planar surface a substantially uniform distribution of attenuated, meltable thermoplastic fibers. The nonabrasive web material is heated sufficiently to cause the attenuated thermoplastic fibers to soften and shrink, thereby forming nodulated fiber remnants. These nodulated abrasive fiber remnants comprise about 10%–50% by weight of the total fiber content of the web material and impart a roughened abrasive characteristic to the planar surface of the resultant web material.

A better understanding of the objects, advantages, features, properties and relationships of the invention will be obtained from the following detailed description and accompanying drawings that set forth illustrative embodiments and are indicative of the way in which the principles of the invention are employed.

DESCRIPTION OF A PREFERRED EMBODIMENT

Figure 1:
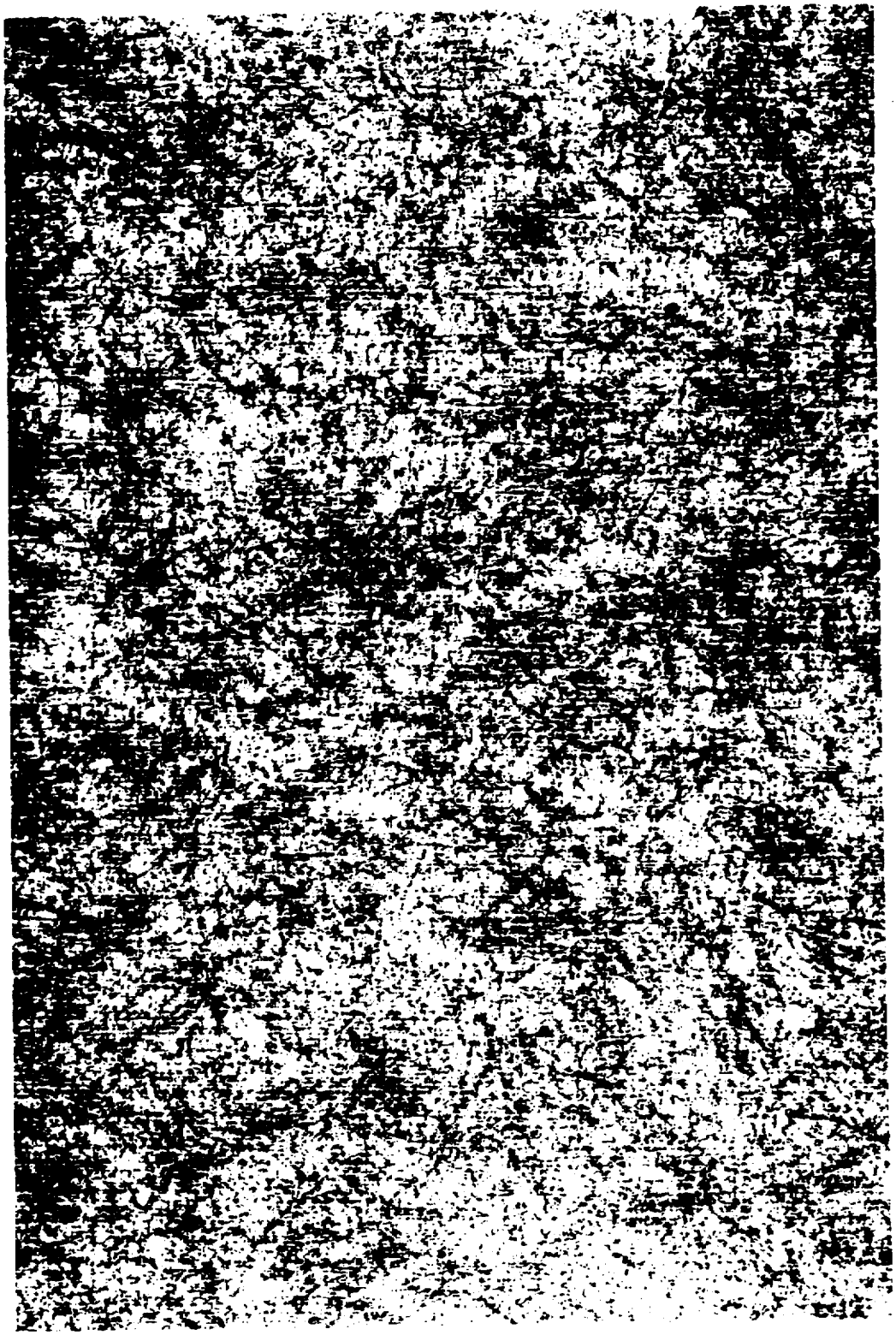
FIG. 1 is a magnified photocopy of the surface of the web material of the present invention at a magnification of 2×.
Figure 2:
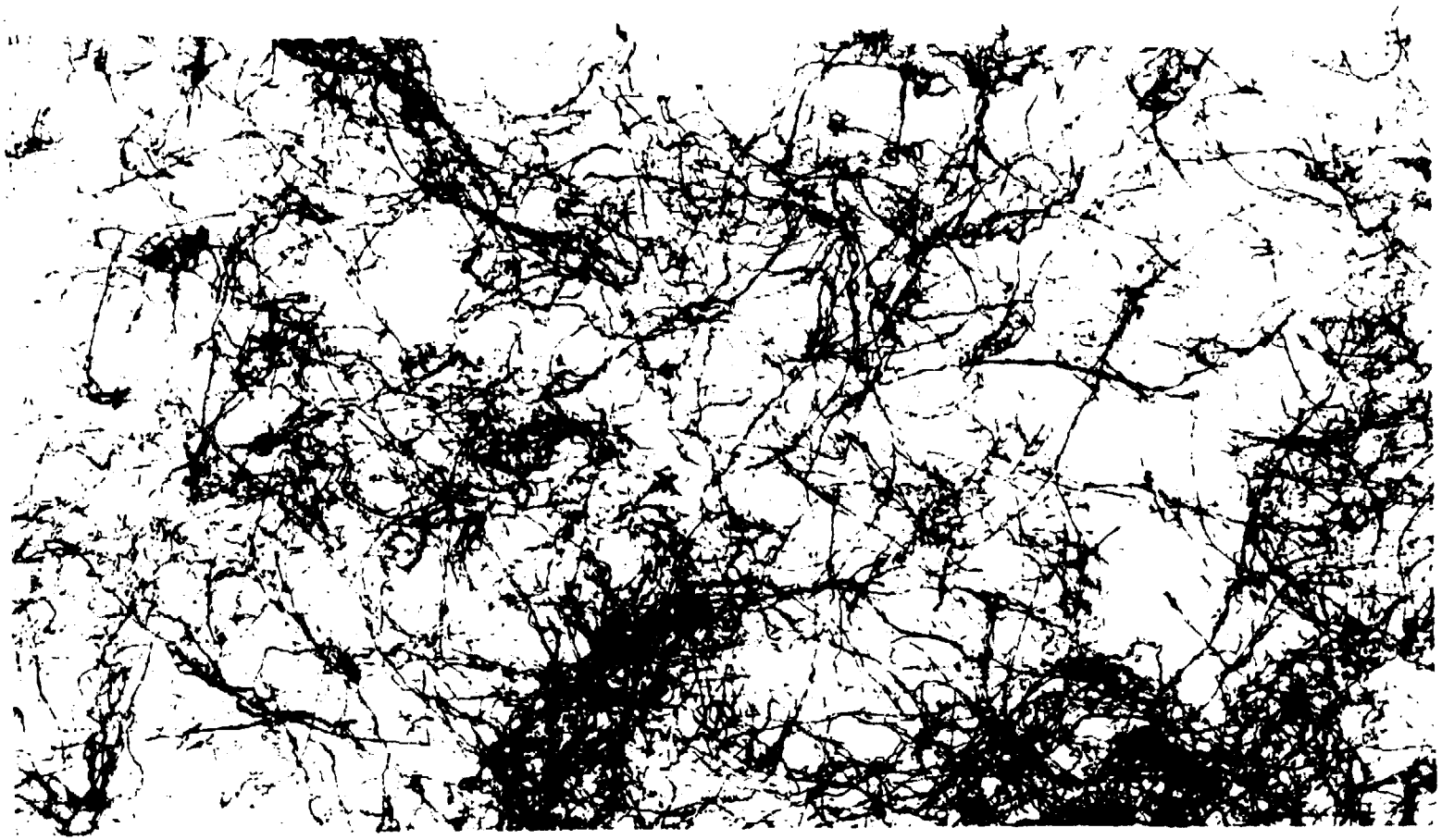
FIG. 2 is a magnified photocopy of the surface of a commercially available spunbond/meltblown web material at the same magnification as FIG. 1.
Figure 3:
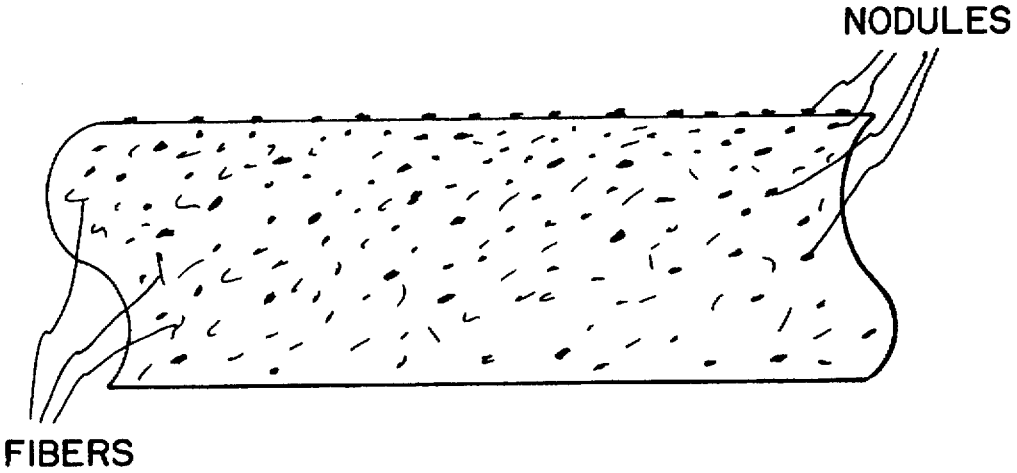
FIG. 3 is an illustration of a cross section of the fibrous web material of the present invention depicting the concentration gradient of the thermoplastic fiber remnants across the thickness of the web, the view being substantially enlarged and somewhat exaggerated for purposes of illustration.

Although the invention is believed to have application to all nonwoven fibrous web materials, for clarity of illustration and ease of understanding it will be described hereinafter in connection with the manufacture of wet laid nonwoven fibrous webs since these webs appear to offer particularly unique characteristics.

In accordance with the present invention, there is provided a single layer, abrasive, nonwoven fibrous material having a first abrasive planar surface formed predominantly of substantially uniformly dispersed nodulated abrasive fiber remnants. In one embodiment according to the invention, the concentration of the abrasive fiber remnants decreases across the thickness of the web material from the abrasive planar surface to the opposite planar surface of the web. The abrasive fiber gradient across the web can vary significantly, but generally provides that one surface of the web material be abrasive and the opposite surface be nonabrasive. The nodulated abrasive fiber remnants within the sheet material can constitute the bulk of the fiber content up to about 65% by weight and typically comprise about 10%–50% by weight of the total fiber content of the web material. The material initially is formed as a nonabrasive precursor nonwoven fibrous web material having on one planar surface a substantially uniform distribution of attenuated, meltable or thermoplastic fibers. The precursor sheet is heated sufficiently to cause the attenuated fibers to soften, compact or shrink, thereby forming nodules or, more specifically, nodulated fiber remnants that impart a roughened or abrasive characteristic to at least one planar surface of the resulting web material.

In carrying out the present invention, the precursor fibrous web or sheet material is initially produced in the form of a continuous web material, preferably in accordance with known and conventional papermaking techniques. Of course, other web forming techniques such as air-laid processes may be employed, but in those instances the thermoplastic fiber concentration gradient is not as readily achieved. The nonwoven fibrous precursor web used to produce the material of the present invention that exhibits the improved properties, characteris- tics and uses set forth herein preferably is made by a wet papermaking process that involves the general steps of forming a fluid dispersion of the requisite fibers and depositing the dispersed fibers on a fiber collecting wire in the form of a continuous sheet-like web material. The fiber dispersion may be formed in a conventional manner using water as the dispersant or by employing other suitable fluid dispersing media. Preferably aqueous dispersions are employed in accordance with known papermaking techniques and, accordingly, the fiber dispersion is formed as a dilute aqueous suspension or furnish of papermaking fibers. The fiber furnish is then conveyed via the headbox to the web-forming screen or wire, such as a Fourdrinier wire, of a papermaking machine and the fibers are deposited on the wire to form the fibrous precursor web or sheet that is subsequently dried in a conventional manner and subjected to the heating required to form the nodulated fiber remnants and abrasive surface characteristics of the desired web material.

Although substantially all commercial papermaking machines, including rotary cylinder machines, may be used, it is desirable where long fibers and/or very dilute fiber furnishes are employed to use an inclined fiber collecting wire, such as that described in the Osborne U.S. Pat. No. 2,045,095, issued on Jun. 23, 1936. The fibers flowing from the headbox are retained on the wire in a random threedimensional network or configuration with slight orientation in the machine direction while the aqueous dispersant quickly passes through the wire and is rapidly and effectively removed.

The fiber furnish is a blend of natural pulp and man-made fibers with the thermoplastic fiber component of the fiber furnish being one of if not the major fiber component, though not necessarily the predominant component. While the pulp component can be selected from substantially any class of pulp or blends, it is preferably characterized by being entirely natural cellulosic fiber, such as bleached kraft, and can include cotton as well as wood fibers, although softwood papermaking pulp such as spruce, hemlock, cedar and pine are typically employed. Hardwood pulp and nonwood pulp, such as abaca, hemp and sisal may also be used. For example, if additional strength and absorbency are required, long vegetable fibers, such as the natural unbeaten fibers of manila hemp, caroa, flax, jute and Indian hemp may be employed. These very long, natural fibers supplement the strength characteristics provided by the bleached kraft and at the same time provide a limited degree of bulk and absorbency coupled with a natural toughness and added burst strength.

The fiber furnish also contains, in accordance with the present invention, a significant concentration of synthetic or man-made non-nodular forming fibers blended with the wood pulp. These fibers are typically of two types: strength imparting fibers and bonding fibers. The strength-imparting synthetic fibers used in accordance with the present invention have the added advantage of contributing to the wet mullen of the web and of helping to carry the web at the wet end of the papermaking machine. These materials include, but are not limited to synthetic organic polymers and copolymers of polyamides such as nylon, acrylics, polyesters such as polyethylene terephthalate and vinyls such as polyvinylidene chloride. Among these materials the polyesters are preferred, such as the polyester sold by DuPont under the trade name "Dacron". The fibers are preferably of a low denier of about 1.5–6 dpf (denier per filament). Generally, the lower denier materials are of slightly shorter length than the higher denier fibers in view of their tendency to entangle prior to deposition on the web forming screen. Accordingly, fiber lengths of about 5–15 mm are typical. The furnish typically contains about 5%–20% by weight of such synthetic materials with amounts of about 5%–15% being preferred.

The synthetic bonding fibers employed in the fiber furnish include thermoplastic low denier fibers, such as the fibers of a copolymer of polyvinyl acetate, commonly referred to as "Vinyon", polyolefin fibers of polyethylene and polypropylene, bicomponent fibers where at least one component is low melting and highly fibrillated materials referred to as "synthetic pulp". The latter are short rod-like synthetic fibers that exhibit a fibrilliform morphology and resultant high specific surface area. These materials readily disperse in water and do not exhibit the tendency to "float out" in chests and holding tanks. All of these fibers have a relatively low melting point at or near the drying temperature of about 100° C. so as to provide their bonding action when the web material is dried using dryer drums and the like. These materials may comprise about 10–15 percent of the total fiber furnish when the preferred bicomponent fibers are employed. A typical bicomponent material is the polyethylene coated polyethylene terephthalate fibrous material sold by Hoechst Celanese under the trade name "Celbond".

The thermoplastic materials responsible for the abrasive characteristics of the web should exhibit the property of contracting or shrinking into globules or nodulated fiber remnants when the temperature of the web is raised to near the melting point of the thermoplastic polymeric material. In order to achieve this characteristic, it is generally desired to use drawn or attenuated fibers so that when the fibers approach their melting condition, they have a natural tendency to draw in upon themselves, and contract or shrink so as to form the required nodular configuration. These fibers exhibit a moderate to high molecular orientation as well as a medium level of tenacity and elongation. Typical of such materials are the melt spinnable thermoplastics generally produced in the form of continuous filamentary tow that is subjected to deliberate drawing operations. These include thermoplastic synthetic materials of the type conventionally employed in the meltblown process described in the aforementioned Lamers et al U.S. Pat. No. 4,659,609. The thermoplastic materials are typically selected from the group of materials including one or more polyolefins, polyesters, polyethers, polyvinyl chlorides and polyamides. Copolymers or mixtures of one or more of these materials may also be desirable. For example, polyethylene, polypropylene, polybutylene, polyethylene terephthalate, ethylene vinyl acetate and the like may be employed, although generally the polyolefins, such as polypropylene are preferred for use as the abrasive imparting material. Among these materials, the linear polyolefins are preferred primarily due to their relatively lower melting point. The fibers exhibit a molecular orientation resulting from the drawing or attenuating operation. Thus, the fibers tend to be relatively straight, although crimped fibers may be used for certain applications. Depending upon the dispersability of the fibers, they may exhibit rough or irregular surface characteristics that may enhance the mechanical bonding of the thermoplastic material within the fibrous structure. Generally, the fibers should not be capable of extensive elongation, i.e., elongation of at least about 2.5 times their original length. Typically, the percent elongation of the material is less than 200%, the elongation varying with the extent of attenuation imparted to the fibers during their formation.

The tenacity of the meltable fibers is about 2–5 times that of similar material in an undrawn condition. Consequently, a minimum tenacity of about three grams per denier is preferred. However, it is recognized that somewhat lower tenacities may be employed in accordance with the present invention so long as the resultant material will exhibit the desired contraction upon heating to its melting point. These fibers are preferably of a low to medium denier, about 1.5–60 dpf, and preferably 4–30 dpf.

The meltable, nodular forming fibers are of paper forming quality when used to form the web and contribute to the uniform distribution of these fibers in the web material. Further, although the furnish is well mixed prior to delivery to the headbox, the polyolefin and other preferred nodular forming fibers exhibit a low density and therefore tend to float to the surface of the furnish within the headbox, so that during deposition they are more predominantly concentrated at one surface, i.e., the top surface, of the resultant web material. The materials having a denier of about 5–15 dpf and a length of about 5–15 mm are more readily dispersed and yet provide the requisite rough abrasive characteristics. The length of the fibers, as mentioned, will vary depending on the denier. For example, materials having a denier of only about 4 can be used at length of from 5 mm, while heavier weight material may be employed as longer fibers. Of course, as will be appreciated, longer fibers should not be so long as to prevent their adequate dispersion within the aqueous slurry of the fiber furnish, yet they should be large enough to impart the abrasive characteristics to the web.

Although the amount of synthetic thermoplastic fibers used in the furnish may also vary depending upon other components, it is generally preferred that about 50% by weight or less of nodular forming fibers be employed. Typically, the content of the attenuated synthetic fibers will be between 10% and 50% of the total fiber furnish, with 20%–40% of such fibers generally being preferred.

Using a conventional papermaking technique, the fibers are dispersed at a fiber concentration within the range of 0.5%–0.005% by weight and are preferably used at a fiber concentration of about 0.2%–0.02% by weight. As will be appreciated, paper-making aids, such as dispersing agents, may be incorporated into the fibrous slurry together with wet strength agents. These materials constitute only a minor portion of the total solids weight of the fiber furnish, typically less than 1% by weight, and facilitate uniform fiber deposition while providing the web in its wet condition with sufficient integrity so that it will be capable of retaining its integrity during subsequent operations, such as hydroentanglement operations. These dispersants may include natural materials, such as guar gum, karaya gum and the like, as well as man-made resin additives.

The wet strength agent added to the furnish prior to web formation may include any one of a number of well-known materials suited for addition to the fiber furnish. These may include various resins such as polyacrylamide; however, the preferred material is a polyamide-epichlorohydrin resin. It is a cationic water soluble thermosetting reaction product of epichlorohydrin and a polyamide and contains secondary amine groups. A typical material of this type is sold by Hercules Chemical Company under the trademark "Kymene 557H".

Resins of this type are more fully described in Jones et al U.S. Pat. No. 4,218,286, issued Aug. 18, 1980. The water soluble cationic thermosetting epichlorohydrin-containing resin is usually employed in amounts well less than 2% by weight, this is in the range of 0.01 %–1.5% by weight with the preferred amount being in the range of 0.5%–1.3% by weight.

If hydroentanglement is desired, this operation may be carried out in the manner set forth in the Viazmensky et al U.S. Pat. No. 5,009,747, issued Apr. 23, 1991, the disclosure of which is incorporated herein by reference. While that patent relates to a fiber web having a significantly higher man-made fiber content, preferably within the range of 40%–90% man-made fibers, the hydroentangling operation described therein can efficaciously be employed with the web material of the present invention, preferably prior to the drying operation.

The basis weight of the nonwoven web material of the present invention typically is in the range of about 20–110 grams per square meter although heavier materials may also be used for specific applications. The preferred material exhibits a basis weight of about 30–85 grams per square meter, with a basis weight of about 35–60 grams per square meter being appropriate for most wipe and towel applications.

For wipes and towels particularly, it is important that the material exhibit appropriate strength characteristics. At the same time, in order to achieve the desired absorbency, a minimum amount, if any, of a binder material is incorporated into the fibrous web to impart the necessary strength. Thus, the employment of the bicomponent binding fibers in lieu of any binder treatment is preferred. Of course, as will be appreciated, the tensile strength of the material may be adversely impacted by the absence of a binder treatment while the absorbency or water holding capacity of the material increases with reduced binder. Accordingly, there is a balancing of desired properties at the various strength and absorbency levels. Generally, the average wet tensile strength (average of machine direction and cross direction) of the material should exceed 200 g per 25 mm and preferably should be at least about 400–500 g per 25 mm for light weight material (basis weight of about 35 g per square meter) and at least about 800–900 g per 25 mm for heavier weight materials, such as materials having a basis weight of about 55 g per square meter.

On the other hand, the water holding capacity of the sheet material should be as high as possible. It is generally preferred that the water holding capacity exceed 300% and preferably be in the range of about 400%–700% or more. For these reasons, it is preferred that no latex or similar binder be applied to the web material during formation, but rather the strength characteristics be imparted by use of the above-mentioned binder fibers. The type of nodular forming fiber as well as its denier and amount impact the absorbency. Thus the intermediate denier of 10 dpf in amounts up to about 40% by weight are preferred.

It should also be noted that the basis weight of the nonwoven web material will have an effect on its absorbency rate. Normally, both the lighter weight materials and the heavier weight materials are used without combining them with other sheet materials although combinations of sheets may be used. The lighter weight materials, namely those having a basis weight in the range of about 30–40 g per square meter should have an absorbency rate of less than 5 seconds, while the bulkier heavier weight materials falling within the basis weight range of about 60–90 g per square meter will have a maximum absorbency rate of about 2 seconds.

Since the present invention does not depend on the use of any binder treatment other than the use of binder fibers, the resistance of the material to the initiation of a tear is required. The force required to initiate a tear is substantially greater than that necessary to continue the tear. Therefore, resistance to tear propagation is used to illustrate the beneficial characteristics of the present invention. The tear strengths of the sheet material are measured according to INDA Standard IST 100.1–92. In the test method used, the tear strength is measured by holding the long side of a rectangular 2"×3" specimen, cut in the shorter edge to form two "tongues". The tongues are held by a pair of clamps and the specimen is pulled to simulate a rip. Thus, the tearing strength measured in this method is the maximum force required to continue or propagate a previously started tear in the test specimen. The force registered in the test is the highest peak load recorded during travel of the rip a measured distance, usually about one and one-half inches.

Although the nonabrasive precursor web may be made, dried and stored prior to heating to impart the nodulated abrasive surface, it is generally preferred that the heating take place in line, immediately following web formation. This can be done by incorporating into the drier section of the nonwoven papermaking machine an appropriate heating station or by the utilization of a through drying technique whereby air is passed through the web as it is continuously held against a foraminous support. This preferred through drying operation may follow a predrying on conventional papermaking drum dryers or may be applied to the wet web material as it comes from the wet end of the papermaking machine before the water content of the web has been reduced by a significant level. As mentioned in the Heyse et al U.S. Pat. No. 3,822,182, issued Jul. 2, 1974, the through drying is accomplished by subjecting the web material to the percolation of hot gases therethrough by means of a difference of pressure between the two surfaces of the material while simultaneously heating the material by radiation or convection means. This through drying technique provides for maintaining the web material in an uninterrupted and continuously restrained condition during the entire drying operation until the web has been stabilized and the thermoplastic material has been permitted to approach its melting point, thereby permitting the thermoplastic fibers to contract and nodulate. As mentioned in the foregoing Heyse et al patent, it is essential that the restrained conditions be maintained in a continuous and uninterrupted manner as the web is dried, since the initial effect of the through drying gases will be to remove the water from the wet web material. It is necessary that the material be held on the through dryer for a sufficient length of time to permit not only removal of the moisture, but also the necessary activation of the thermoplastic abrasive nodular formation. This restraint of the web material also prevents the sheet material from shrinking or necking during the drying and nodular forming operations.

The specific operating conditions for the through dryer will vary substantially depending upon the particular end product being made and upon the thermoplastic fibers contained in the web material. Accordingly, the temperature and flow rate of the drying air, the speed of the web through the drying unit and similar operating conditions cannot be delineated or limited to specific values. Although heating to temperatures well in excess of 200° F., and up to about 450° F., is preferred in commercial operations when using polypropylene as the nodular forming thermoplastic, through dryer temperature settings in the range of 350° F. to 400° F. are generally required. The restrained condition of the web during the drying process is readily achieved by providing for the flow of gases against the web, thereby forcing it into intimate engagement with the foraminous carrier of the dryer unit. This restrained condition can be enhanced not only by applying air pressure to the outer surface of the material, but also by simultaneously creating a vacuum condition on the opposite side of the foraminous surface to positively assure that restrained condition of the fibrous web during the entire drying operation. As will be appreciated, the temperature of the through dryer should not be so high as to cause the fibers to melt completely and form a film since such a condition would not provide the desired abrasive nodules on the outer surface of the web material. Additionally, such high temperatures tend to cause the thermoplastic materials to adhere to the machinery, thus requiring shutdown thereof.

TABLE I

| Polypropylene Fiber | | Abrasive Particle Diameter (μ) Temperature | | | |
|---|---|---|---|---|---|
| Denier | Length (mm) | 70° F. | 350° F. | 400° F. | 450° F. |
| 2.2 | 5 | 17.9 | 101 | 115 | 113 |
| 4 | 10 | 28.1 | 145 | 172 | 170 |
| 10 | 10 | 40.4 | 184 | 233 | 194 |
| 55 | 10 | 91.8 | 221 | 249 | 238 |

As shown in Table I, the nodular forming fibrous material, such as polypropylene fibers, tend to contract and form a much larger particle diameter when heated. The initial fiber diameter of most fibers is well below 100 micrometers when incorporated into the precursor fibrous web. However, after heating in a through dryer set at a temperature of 350° F., 400° F. and 450° F., the particles soften, contract and form into nodules having a diameter greater than 100 micrometers and significantly larger than the fiber used in the precursor web. As can be appreciated, the higher denier and therefore thicker initial fibrous material will result in significantly larger particles and, therefore, it is possible to provide sheet material having varying sizes of nodules depending on the specific denier of the initial meltable fiber employed in the precursor nonwoven web material. As is also evident from Table I, the particle size grows as the temperature level increases, but then tends toward the formation of a film, thereby reducing the particle diameter size.

There is no ASTM standard test method for measuring abrasiveness and, therefore, variations of standard tests used for measuring the coefficient of static and kinetic friction and friction forces have been used as a guide. A modification of ASTM D4917-89, TAPPI T549pn-90 or INDA IST 140.1-92 may be employed. In accordance with the test procedure utilized, sheets to be tested are supported on a block or sled of standard size and are drawn across a standardized base sheet material. The sled is pulled across the surface and the force required to do so is measured. The coefficients of both static and kinetic friction can be determined from the force measurements. As will be appreciated, the static force measurements relate to the force required to initiate movement between the two surfaces, while the kinetic force measurements relate to the force required to cause continuation of the movement at a uniform speed. Of course, as will be appreciated, the measurement of friction is not the same as the measurement of abradability and, therefore, the friction test can be used as only a guide in determining the desirability of the abrasive sheet material. Therefore, a tactile determination of abrasiveness is frequently a determinative factor.

TABLE II

| Fiber | Heat | Friction | | | |
|---|---|---|---|---|---|
| | | Static | | Kinetic | |
| Denier | Treatment | Force | Coefficient | Force | Coefficient |
| Meltblown | none | 233.75 | 1.12 | 209.50 | 1.0 |
| 10 | none | 204.44 | 0.98 | 179.94 | 0.86 |

TABLE II-continued

| Fiber | Heat | Friction | | | |
|---|---|---|---|---|---|
| | | Static | | Kinetic | |
| Denier | Treatment | Force | Coefficient | Force | Coefficient |
| 10 | 400° F. | 242.12 | 1.16 | 209.36 | 1.0 |
| 10 | 450° F. | 291.67 | 1.40 | 231.65 | 1.11 |
| 55 | none | 213.06 | 1.02 | 175.35 | 0.84 |
| 55 | 350° F. | 288.61 | 1.38 | 233.55 | 1.12 |
| 55 | 400° F. | 328.33 | 1.57 | 268.25 | 1.29 |
| 55 | 450° F. | 309.44 | 1.48 | 269.16 | 1.29 |

Table II provides a comparison of the friction force and coefficient of friction for a commercially available meltblown product and for materials produced in accordance with the present invention using fibers of both 10 denier and 55 denier at different heat treatment levels.

The following examples are given for purposes of illustration only in order that the present invention may be more fully understood. These examples are not intended to in any way limit the practice of the invention. Unless otherwise specified, all parts are given by weight.

EXAMPLE 1

A nonwoven web material was made from a fiber furnish containing 47% of wood pulp, 15% of the bicomponent fiber comprising polyethylene on polyethylene terephthalate sold under the trade name "Celbond", 3% of 1.5 denier 15 mm polyethylene terephthalate fiber and 35% of 10 denier 10 mm polypropylene fiber using a wet papermaking process. The resultant nonwoven web material exhibited a basis weight of about 42 grams per square meter and was dried on a through dryer at a hood temperature setting of 390° F. The resultant web material exhibited a nodulated top surface, provided excellent results when used as an abrasive wipe, and exhibited the physical properties set forth in Table III.

EXAMPLE 2

The procedure of Example 1 was repeated except that the amount of wood pulp was reduced to 35%, the amount of polyethylene terephthalate fibers was increased to 10% and the polypropylene fibers employed had a size of 4 denier 10 mm and constituted 40% by weight of the fiber content of the furnish. In addition, the through dryer temperature was set at 450° F. during nodulation. The resultant abrasive wipe material also exhibited good abrasive wipe characteristics and the physical properties set forth in Table III.

EXAMPLE 3

The procedure of Example 2 was repeated except that the polypropylene fibers used were of 2.2 denier and 5 mm in length, and the through dryer was operated at a temperature setting of 415° F.. The resultant product also exhibited good abrasive wipe characteristics and the properties set forth in Table III.

TABLE III

| | Example 1 | Example 2 | Example 3 |
|---|---|---|---|
| Dry Tensile (g/25 mm) | | | |
| MD | 1242 | 1178 | 1397 |
| CD | 657 | 697 | 514 |
| Wet Tensile (g/25 mm) | | | |
| MD | 724 | 634 | 884 |
| CD | 379 | 384 | 300 |
| Basis Weight (g/m$^2$) | 42 | 39 | 38 |
| Elmendorf Tear (g) | | | |
| MD | 83 | — | 122 |
| CD | 129 | — | 182 |
| Dry Mullen (g/cm$^2$) | 741 | — | 895 |
| Wet Elongation (%) | | | |
| MD | 8 | 11 | 9 |
| CD | 21 | 22 | 21 |
| Absorption Capacity (%) | 629 | 713 | 714 |
| Thickness (μ) | 359 | 333 | 277 |
| Friction - static | | | |
| Force | 240 | 227 | 212 |
| Coefficient | 1.16 | 1.09 | 1.01 |
| Friction - kinetic | | | |
| Force | 208 | 193 | 188 |
| Coefficient | 1.00 | 0.93 | 0.90 |

As will be apparent to persons skilled in the art, various modifications, adaptations and variations of the foregoing specific disclosure can be made without departing from the teaching of the present invention.

We claim:

1. A single phase, absorbent, abrasive nonwoven fibrous web material containing nodulated fiber remnant particles of a thermoplastic composition, substantially all particles of said thermoplastic composition within said web being nodulated throughout the thickness of the web whereby none of the fiber remnant particles have retained a physical fiber form and appearance, said web material having a water holding capacity of at least about 300%, said web material having a first abrasive planar surface formed predominantly of substantially uniformly dispersed nodulated abrasive thermoplastic fiber remnants, the concentration of said abrasive fiber remnants decreasing across the thickness of the web material from said first abrasive planar surface toward the opposite planar surface of the web to provide an abrasive fiber remnant gradient from the first surface across the interior of the web, said nodulated abrasive fiber remnants comprising about 10%–50% by weight of the total fiber content of the web material.

2. The abrasive web material of claim 1 wherein the nodulated fiber remnants are thermoplastic materials selected from the group consisting of polyolefins, polyesters, polyethers, polyamides and polyvinyl chlorides.

3. The abrasive web material of claim 1 wherein the nodulated fiber remnants are polyolefins selected from the group consisting of polyethylene, polypropylene and polybutylene.

4. The abrasive web material of claim 1 wherein the remnants exhibit an average particle diameter of at least about 100 micrometers and comprise about 20%–40% by weight of the total fiber content.

5. The abrasive web material of claim 1 wherein the web material has a basis weight of about 30–85 grams per square meter and an average wet strength of at least about 400 grams per 25 mm.

6. The abrasive web material of claim 1 wherein the web material is a wet laid nonwoven, the fiber content is a blend of natural and man-made fibers and the nodulated fiber remnants are polypropylene.

7. A single phase abrasive nonwoven fibrous web material having a first abrasive planar surface formed predominantly of substantially uniformly dispersed nodulated abrasive fiber remnants, the concentration of said abrasive fiber remnants decreasing across the thickness of the web material from said first abrasive planar surface toward the opposite planar surface of the web to provide an abrasive fiber remnant gradient across the web, said nodulated abrasive fiber remnants comprising about 10%–50% by weight of the total fiber content of the web material, wherein the nodulated fiber remnants exhibit an average particle diameter of at least about 100 micrometers and the web material has a basis weight of about 30–85 grams per square meter, an average wet strength of at least about 400 grams per 25 mm and a water holding capacity exceeding 300%.

8. An abrasive nonwoven fibrous web material having a first abrasive planar surface comprising substantially uniformly dispersed nodulated abrasive fiber remnants having an average particle diameter of at least about 100 micrometers, said nodulated fiber remnants not having the physical form and appearance of fibers and having a concentration that decreases from the first surface through the interior of the web to provide a fiber remnant concentration gradient across the thickness of the web, said web material having a basis weight in the range of about 20–110 grams per square meter, an average wet tensile strength of at least 200 grams per 25 mm and a water holding capacity of at least about 300%, said nodulated abrasive fiber remnants comprising about 10%–50% by weight of the total fiber content of the web material.

9. The abrasive web material of claim 8 wherein the nodulated fiber remnants are polyolefins selected from the group consisting of polyethylene, polypropylene and polybutylene.

* * * * *